United States Patent [19]

Lautenschlager et al.

[11] 4,161,294

[45] Jul. 17, 1979

[54] BLOWER BEATER MILL

[75] Inventors: Friedrich W. Lautenschläger, Gechingen; Hermann Hennecke, Mülheim, both of Fed. Rep. of Germany

[73] Assignee: Deutsche Babcock Aktiengesellschaft, Oberhausen, Fed. Rep. of Germany

[21] Appl. No.: 861,540

[22] Filed: Dec. 19, 1977

[30] Foreign Application Priority Data

Jun. 25, 1977 [DE] Fed. Rep. of Germany ..... 2728750

[51] Int. Cl.[2] ..... B02C 13/10

[52] U.S. Cl. ..... 241/56; 241/66; 241/67; 241/191

[58] Field of Search ..... 241/56, 66, 67, 188 R, 241/189 R, 189 A, 191, 194

[56] References Cited

U.S. PATENT DOCUMENTS

| | | | |
|---|---|---|---|
| 551,097 | 12/1895 | Russell | 241/188 R X |
| 1,038,886 | 9/1912 | Hirt | 241/188 R X |
| 3,157,366 | 11/1964 | Rogers | 241/56 UX |
| 3,880,366 | 4/1975 | Luevenich | 241/194 |
| 3,993,254 | 11/1976 | Bicik et al. | 241/67 |
| 4,008,858 | 2/1977 | Yamada et al. | 241/67 |

FOREIGN PATENT DOCUMENTS

| | | | |
|---|---|---|---|
| 2605751 | 9/1976 | Fed. Rep. of Germany | 241/194 |

*Primary Examiner*—Howard N. Goldberg
*Attorney, Agent, or Firm*—Max Fogiel

[57] ABSTRACT

A blower beater mill for grinding and drying operations in which a rotor is provided with a beater portion located on the mill shaft and has also a fan impeller. Beater arms of a beater portion are fastened between hub rings of the mill shaft. The shaft is water-cooled along its longitudinal axis. Shaft crests of the hub rings are enclosed by a jacket at a spaced distance therefrom. The jacket is made of individual rings through which the beater arms pass. The width of these rings is slightly larger than the spacing between two adjacent rows of beater arms. The rings, moreover, overlap in the area of cutouts of the beater arms. The rings may have U-shaped profiles with vertical legs inserted together with the beater arms into grooves between the hub rings. The space between two adjacent U-shaped rings and two adjacent beater arms, located within one beater arm row, is covered by sheet metal connected to the rings and the beater arms. The vertical legs of the U-shaped rings extend close to the bottom of the grooves and are penetrated by hub bolts holding the beater arms. The vertical legs, furthermore, may have cutouts at a level above the hub rings. A coolant gas source may be connected to the space between the rings of the jacket and the hub rings.

9 Claims, 5 Drawing Figures

BLOWER BEATER MILL

BACKGROUND OF THE INVENTION

The present invention relates to a blower beater mill for grinding and drying. A rotor has a beater portion located on the mill shaft and a fan impeller. The beater arms of the beater portion are fastened between hub rings of the mill shaft. The mill shaft is water cooled along its longitudinal axis.

Such mills, to dry the wet material to be ground, suck hot flue gases through a suction duct from the combustion chamber of the boiler. Hence the rotor is subjected during the grinding-drying process and during startup and rundown to a high temperature load.

It is known in the art how to cool the mill shaft over an inside borehole. Also, the mill shaft in the area of the entry cross-section of the mill can be enclosed with a shaft protection tube, with cooling air being conducted through the space between shaft protection tube and mill shaft.

With a known blower beater mill whose mill shaft is not equipped with an inside borehole for water cooling, the cooling air passing between shaft protection tube and mill shaft is passed through cooling channels located between the hub of the rotor and the shaft. In order to achieve adequate cooling of the mill shaft in this blower beater mill, large cooling air quantities must be passed through these cooling channels. Nevertheless, the mill shaft gets relatively hot so that the mill shaft cooled in this manner is inferior to a mill shaft cooled with water through an inside borehole.

It is, therefore, an object of the present invention to protect the mill shaft of a blower beater mill of the above type, in such a way, that high temperatures on the shaft crest are avoided and the temperature differential across the shaft cross-section is reduced.

Another object of the present invention is to provide an arrangement of the foregoing character which is substantially simple in construction and may be economically fabricated.

A further object of the present invention is to provide an arrangement, as described, which may be readily maintained in service and which has a substantially long operating life.

SUMMARY OF THE INVENTION

The objects of the present invention are achieved by providing that the shaft crests of the hub rings are enclosed at a distance by a jacket made up of individual rings through which the beater arms pass. The rings may be laid out so that their width is slightly larger than the space between two adjacent rows of beater arms, and so that they overlap in the region where the beater arms pass through. The rings may also be U-shaped, with the vertical legs of these rings, together with the beater arms, being inserted into the grooves between the hub rings.

The air in the space between the outer jacket and the shaft crests of the hub rings causes a certain thermal insulation. Also, a gaseous coolant can be passed through the space. In this manner, the mill shaft is protected against excessive temperature load. The make-up of the jacket from individual rings in a simple manner allows passing the beater arms through the jacket. The assembly and disassembly of the beater arms is not impaired. Also, the thermal expansion can be controlled, so that no stresses appear in the jacket.

A particularly advantageous embodiment for joint assembly and disassembly of the beater arms and of the rings, provides that the vertical legs of the U-shaped rings reach to nearly the bottom of the groove and are penetrated by the hub bolts holding the beater arms.

If the access of hot flue gas to the shaft crests of the hub rings is to be prevented as much as possible, another embodiment of the invention may provide that the space between two adjacent U-shaped rings and two adjacent beater arms in one beater arm row be covered by a metallic sheet connected to the rings and the beater arms.

In order to deliver the gaseous coolant into the space between the shaft crests of the hub rings and the jacket formed from the rings, a cooling gas source may be connected to the space. Alternatively, outside the mill housing, an axial blower may be located on the mill shaft. The exit cross-section of this blower is connected to the space between jacket and hub rings. The vertical legs of the U-shaped rings at a level above the hub rings have cutouts to conduct the cooling gas.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
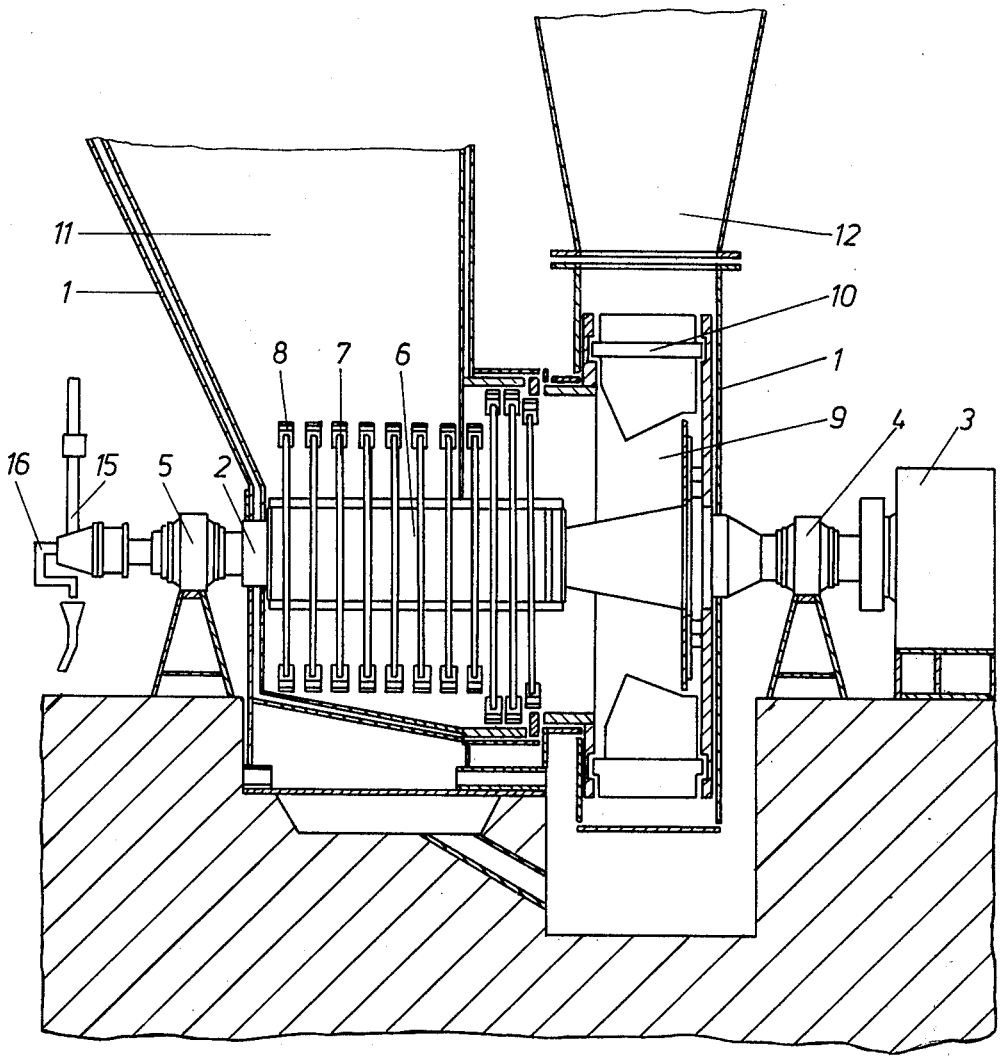
FIG. 1 shows a lengthwise section through a blower beater mill.

The blower beater mill contains a rotor located in a mill housing 1. The rotor comprises the mill shaft 2 which is driven by a motor 3 via a transmission and which is held in two bearings 4 and 5 located outside the mill housing. The mill shaft mounts a beater portion 6 with beater arms 7 in several rows, and attached beater heads 8 and a fan impeller 9 with radial blades 10.

The fan impeller 9 acting as a blower, through a suction duct, sucks in hot flue gasses from the combustion chamber of a boiler (not shown). The material to be ground, in this case natural brown coal, is placed in the suction duct and together with the hot flue gasses reaches the mill through the mill intake 11 connected to the suction duct. The ground material is delivered to the burners (not shown) of the boiler through a transition piece 12 and a dust line connected thereto.

The mill shaft 2 is water-cooled on the inside and has a central borehole 13, for this purpose, which holds a pipe 14 of smaller diameter. The pipe 14 is connected to the cooling water intake 15 on the outside of mill housing 1, and the ring channel between the pipe 14 and the wall of borehole 13 is connected to the cooling water return line 16.

Grooves 17 are lathe-turned into the shaft body so that hub rings 18 are formed. The beater arms 7 are inserted into the grooves 17 between the hub rings. They are held by hub bolts 19 which pass through holes in the hub rings 18 and the bases of the beater arms 7. The hub bolts 19 are fixed by securing disks which are attached to the first and the last hub ring 18 in order to prevent shifting.

The shaft crests 20 of the hub rings 18 are surrounded at a distance by a jacket which is made up of individual rings 21, 22. These rings 21, 22 on one edge, have lateral cutouts 23 for the passage of beater arms 7. The rings 21, 22 are slightly wider than the distance between two beater arms 7 so that they overlap in the area of the cutouts for the beater arms 7. Every second ring 21 is supported by the shaft crests 20 of hubs rings 18. The rings 22 in between are detachably connected to these rings 21, as for example, by screws. With this arrangement, the beater arms 7 can be replaced by lifting individual rings 21, 22.

Figure 3:
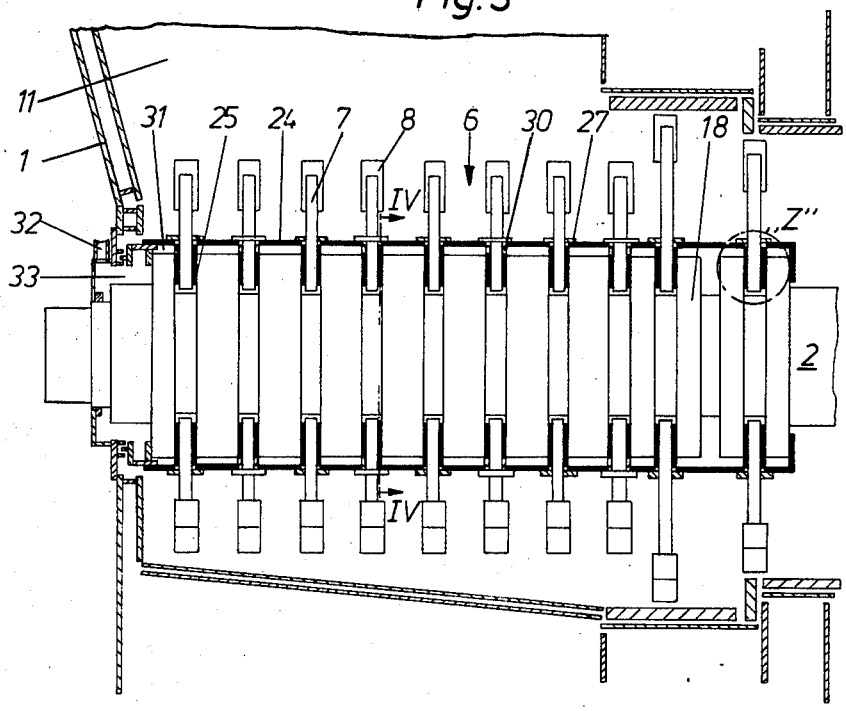
FIG. 3 shows another embodiment of a lengthwise section of the beater section.
Figure 5:
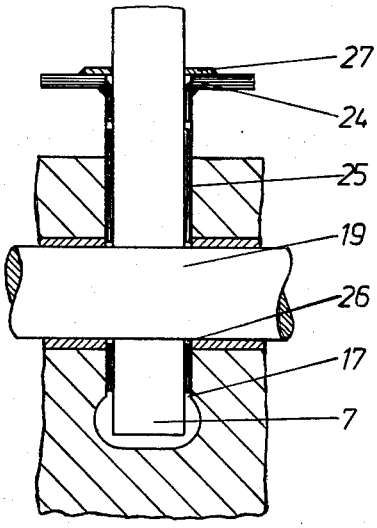
FIG. 5 shows a detail Z of FIG. 3.
Figure 4:
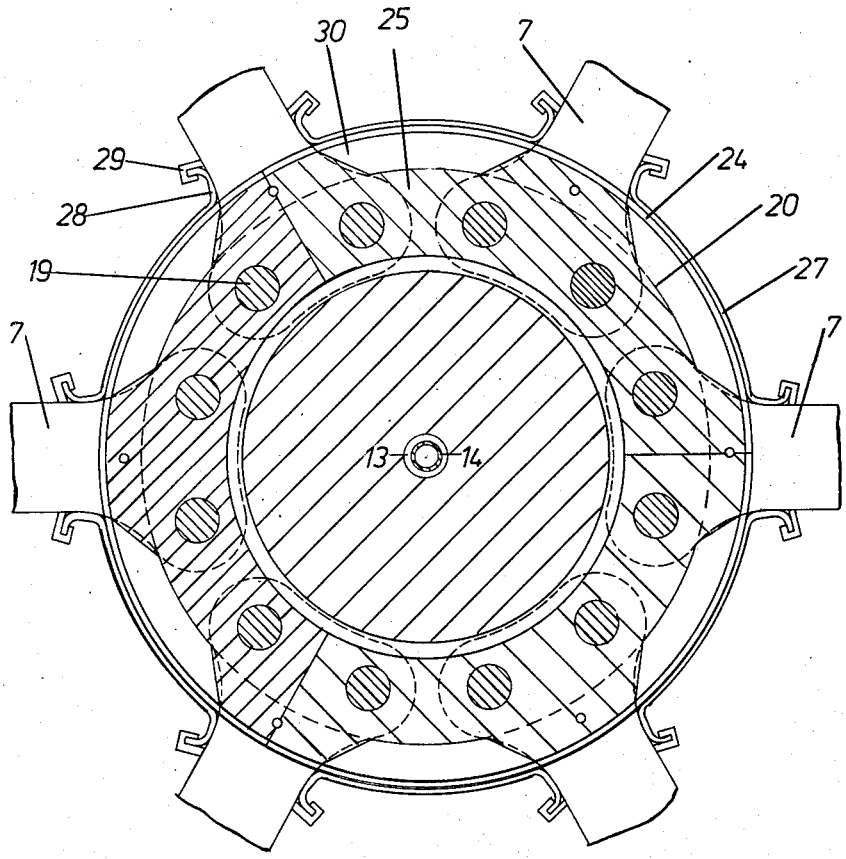
FIG. 4 shows a section taken along line IV—IV in FIG. 3.

The rings 24, shown in FIGS. 3 to 5 and forming the jacket, have a U-shaped profile. The comprise a portion running in the lengthwise direction of the mill shaft; this portion is as wide as the space between two adjacent rows of beater arms 7 and are welded to the legs 25, perpendicular to it. These legs 25 together with the beater arms 7 are inserted into the grooves 17 between the hub rings 18. They reach almost to the bottom of groove 17 and in their lower portion they have a hole 26. The hub bolt 19 fastening the associated beater arm 7 passes through this hole 26. The U-profile rings 24 and the beater arms 7 can be assembled and disassembled through this type of mounting.

The space between two adjacent U-profile rings 24 and two adjacent beater arms 7, which remains free within one beater arm row, is covered by a metallic sheet 27. This metallic sheet 27 is connected to the U-profile rings 24 by a straight weld. Lateral attachment pieces 28 of metallic sheets 27 engage hooks 29 which are welded to the beater arms 7.

Above the shaft crests 20 of hub rings 18, these legs 25 have cutouts 30 which serve to conduct a cooling gas, as for example, air, through the space 31 between the shaft crests 20 of hub rings 18. This cooling gas is supplied from a coolant source (not shown), enters through a pipe stub 32 into a non-rotating annular chamber 33, is forced through the space 31, and leaves through cutouts 30 in the last leg of the rear U-profile ring 24.

Figure 2:
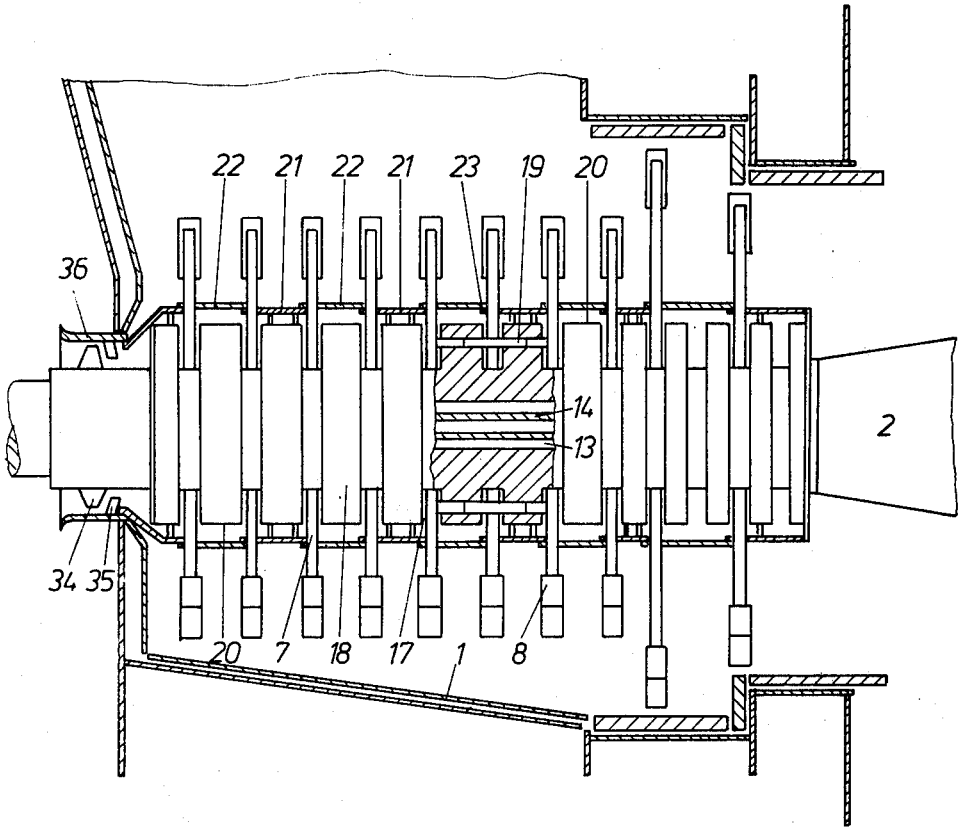
FIG. 2 shows the beater section of the blower beater mill in a lengthwise section.

Another way of supplying the space 31 with cooling air, according to FIG. 2, uses an axial blower located on the trunnion of mill shaft 2. This trunnion is between the mill intake 11 and bearing 5 which is a loose or floating bearing. This axial blower comprises a rotor 34, rotating with the mill shaft 2, which is followed by a guide wheel 35 that is stationary relative to the mill shaft 2. The rotor 34 rotates in a blower housing 36 having an intake portion. The housing is connected to the mill housing 1. The exit cross-section of the axial blower discharges into space 31 between the shaft crests 20 of hub rings 18 and the jacket formed of rings 21, 22.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention, and therefore, such adaptations should and are intended to be comprehended within the meaning and range of equivalence of the following claims.

We claim:

1. A blower beater mill for grinding and drying, comprising: a mill shaft water-cooled along its longitudinal axis and having hub rings; a rotor having a beater portion located on said mill shaft and having a fan impeller; beater arms of a beater portion being fastened between said hub rings of said mill shaft; said hub rings having shaft crests; jacket means enclosing said shaft crests at a spaced distance therefrom; said jacket means comprising individual rings, said beater arms passing through said individual rings.

2. A blower beater mill as defined in claim 1 wherein said beater arms are arranged in spaced adjacent rows, said rings having cutouts for the passage of said beater arms, said rings having a width substantially larger than the spacing between two adjacent rows of beater arms, said rings overlapping in an area of said cutouts of said beater arms.

3. A blower beater mill as defined in claim 1 wherein said rings have U-shaped profiles and have vertical legs, said vertical legs together with said beater arms being inserted into grooves between said hub rings.

4. A blower beater mill as defined in claim 3 wherein said rings with U-shaped profile are spaced from each other, said beater arms being arranged in rows, and wherein a metallic sheet member covers the space between two adjacent U-shaped rings and two adjacent beater arms located within one beater arm row, said metallic sheet being connected to said U-shaped rings and said beater arms.

5. A blower beater mill as defined in claim 3 including hub bolts holding said beater arms; said vertical legs of said U-shaped rings extending substantially close to the bottom of said grooves, said vertical legs being penetrated by said hub bolts.

6. A blower beater mill as defined in claim 3 wherein said vertical legs of said U-shaped rings have cutouts at a level above said hub rings.

7. A blower beater mill as defined in claim 1 wherein space between said rings of said jacket means and said hub rings is connectable to a coolant gas.

8. A blower beater mill as defined in claim 1 including a mill housing; an axial blower located outside of said mill housing and on said mill shaft; said axial blower having a discharge area connected to a space between said rings of said jacket means and said hub rings.

9. A blower beater mill as defined in claim 1 wherein, said beater arms being arranged in spaced adjacent rows, said rings having U-shaped profiles and having vertical legs; said rings of said jacket means together with said beater arms being inserted into grooves between said hub rings; said U-shaped rings being spaced from each other; a metallic sheet covering space between two adjacent U-shaped rings and two adjacent beater arms located within one beater arm row, said metallic sheet being connected to said rings of said jacket means and said beater arms; hub bolts holding said beater arms, said vertical legs of said U-shaped rings extending close to the bottom of said grooves, said vertical legs being penetrated by said hub bolts; said vertical legs having cutouts at a level above said hub rings; space between said rings of said jacket means and said hub rings being connectable to a coolant gas; a mill housing; and an axial blower located outside said mill housing on said mill shaft, said axial blower having a discharge area connected to a space between said rings of said jacket means and said hub rings.

* * * * *